US006227896B1

(12) United States Patent
Chang

(10) Patent No.: US 6,227,896 B1
(45) Date of Patent: May 8, 2001

(54) TERMINAL CONNECTION MECHANISM USED FOR A BACKLIT DISPLAY

(76) Inventor: George Chang, 12F, No. 100, Sec. 1, Hsin Tai 5th Road, SiTz Chang, Taipei Hsien (TW)

( * ) Notice: Subject to any disclaimer, the term of this patent is extended or adjusted under 35 U.S.C. 154(b) by 0 days.

(21) Appl. No.: 09/568,417

(22) Filed: May 10, 2000

(51) Int. Cl.[7] ..... H01R 13/625; H01R 4/50; H01R 13/627

(52) U.S. Cl. ..... 439/354; 439/344

(58) Field of Search ..... 439/344, 354, 439/358; 362/235, 486, 475, 441

(56) References Cited

U.S. PATENT DOCUMENTS 4,339,787 * 7/1982 Burnbaum ..... 362/121
4,782,434 * 11/1988 Cole ..... 362/252
5,993,236 * 11/1999 Vanderhoof et al. ..... 439/344
6,116,939 * 9/2000 Fukuda ..... 439/354

* cited by examiner

*Primary Examiner*—P. Bradley
*Assistant Examiner*—Edwin A. León
(74) *Attorney, Agent, or Firm*—Rosenberg, Klein & Lee

(57) ABSTRACT

A terminal connection mechanism used in an electroluminescent display structure primarily comprises a display panel housed in a decorative case and a terminal portion provided on the lower end of the display panel to receive a connector affixed by electrical conductive wires. The connector is provided on one side wall face thereof with a resilient locating plate that enables the connector to be detachably secured in position in the case. Thus the terminal connection mechanism according to the invention can provide an electroluminescent display the convenience in connection and separation between a display panel and its electrical conductive wires. It has practical value in industry.

2 Claims, 2 Drawing Sheets

TERMINAL CONNECTION MECHANISM USED FOR A BACKLIT DISPLAY

BACKGROUND OF THE INVENTION

The prior art structure of an electroluminescent display comprises a transparent case housing a display panel. Electrical conductive wires are directly attached to the terminal end of the display panel by soldering to form an undetachable assembly. Such a configuration considerably limits its application and lifetime. Even if it is partly damaged, the whole structure must be abandoned. Hence it is desirable to have improvements made on this deficiency. In addition, using soldering to combine a panel with electrical conductive wires provides inconvenience in use.

In view of the above-mentioned drawbacks, the primary object of the invention is to provide an improved terminal connection mechanism used in an electroluminescent display structure that enables the display panel to be detachably combined with electrical conductive wires in an easy and simple way. Thus it promotes convenience in use. Now the structure and features of the invention will be described in more detail with reference to the accompanying drawings.

BRIEF DESCRIPTION OF THE ACCOMPANYING DRAWINGS

DETAILED DESCRIPTION OF PREFERRED EMBODIMENTS

Figure 1:
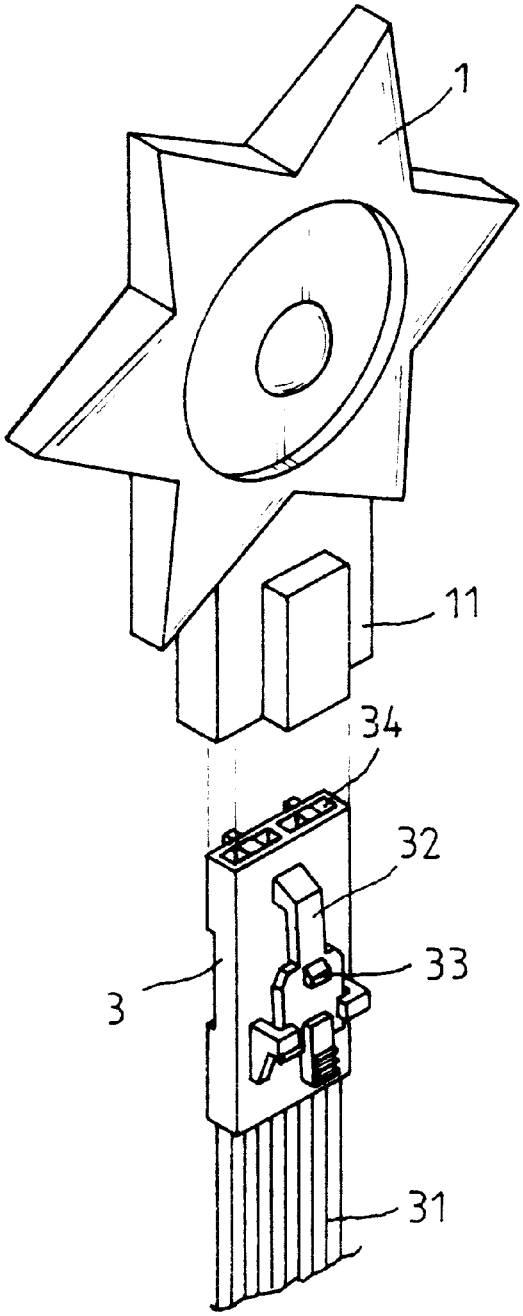
FIG. 1 is an explode view showing an electroluminescent display that uses a terminal connection mechanism according to the invention.
Figure 2:
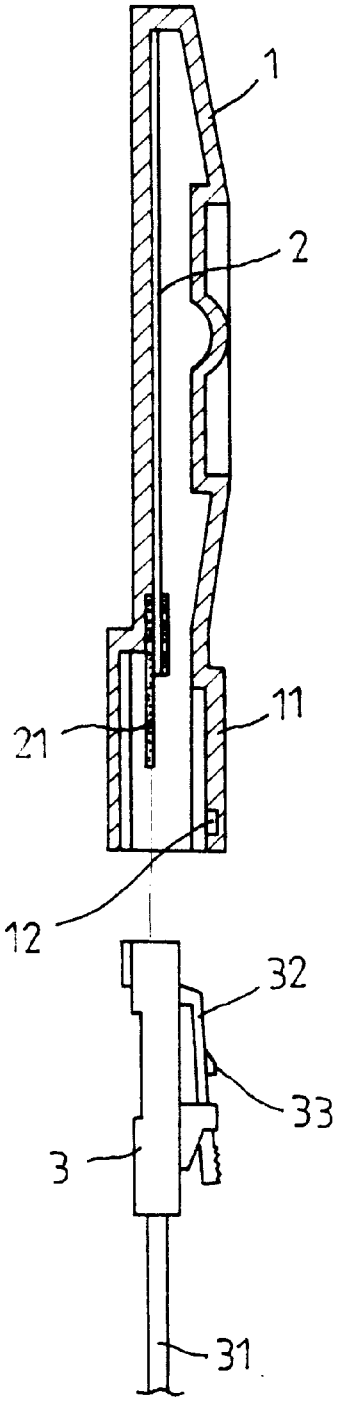
FIG. 2 is a cross sectional plan view showing the electroluminescent display of FIG. 1.
Figure 3:
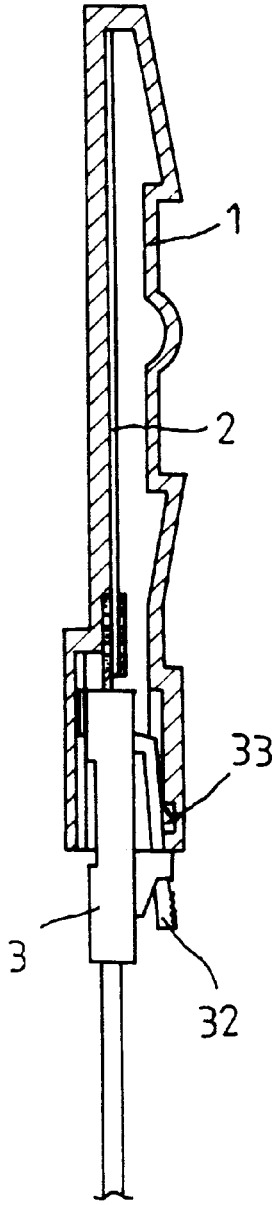
FIG. 3 is a cross sectional view indicating the electroluminescent display of FIG. 1 in an assembled state.

With reference to the accompanying drawings, the invention comprises a separated decorative case (1) with a receiving compartment (11) formed on the lower portion thereof. The receiving compartment (11) is further provided on the inner wall face with a recess (12). A display panel (2) is housed in the case (1), with a terminal portion (21) on the lower end extending into the receiving compartment (11).

A connector (3), one end of which is affixed by electrical conductive wires (31) and the other end is provided with an opening (34), is inserted into the receiving compartment (11) so that the opening (34) is associated with the terminal portion (21) of the display panel (2) to form an electrical connection.

The present invention is further featured by a resilient locating plate (2) formed on one side surface of the connector (3). The locating plate (2) is configured to have a protrusion (33), which falls into the recess (12) when the connector (3) is seated in the receiving compartment (11) to engage the connector (3) with the decorative case (1) to obtain a secure lock effect. To separate the connector (3) from the case (1), users can press down the free end of the resilient locating plate (2), which is exposed to the outside when the connector (3) is accommodated in the case (1), and pull the connector (3) out of the case (1) with ease. Thus the invention enables a case (1) to be replaced at will.

From the above description, evidently the invention is an advancement in art and has originality. We hereby file an application for a patent grant.

What is claimed is:

1. A terminal connection mechanism comprising a case and a connector;

said case being provided on the lower portion thereof with a receiving compartment and enclosing an electroluminescent display panel therein, and said connector having an opening disposed on one end thereof and being affixed by electrical conductive wires on another end, which opening is associated with a terminal portion of said display panel to join the connector with the case to form an electrical connection when the connector is inserted into said receiving compartment.

2. A terminal connection mechanism as recited in claim 1, said receiving compartment being provided on an inner wall face with a recess, said connector being provided on one side with a resilient locating plate, said resilient locating plate being further provided on an outer surface thereof with a protrusion, which falls into said recess to engage said connector with said case to obtain a secure locking effect and for providing convenience in separation of the connector from the case by pressing down a free end of the resilient locating plate to allow egress of the protrusion escape from the recess.

* * * * *